US008677795B2

(12) United States Patent
Deplano et al.

(10) Patent No.: US 8,677,795 B2
(45) Date of Patent: Mar. 25, 2014

(54) EXTRUSION PRESS COMPRISING A CONTROL APPARATUS AND METHOD FOR HANDLING THE CONTAINER IN SUCH AN EXTRUSION PRESS

(75) Inventors: Stefano Deplano, Genoa (IT); Umberto Magnoli, Milan (IT); Maurizio Borgonovo, Legnano (IT)

(73) Assignee: Danieli & C. Officine Meccaniche S.p.A., Buttrio (IT)

( * ) Notice: Subject to any disclaimer, the term of this patent is extended or adjusted under 35 U.S.C. 154(b) by 0 days.

(21) Appl. No.: 12/998,549

(22) PCT Filed: Nov. 3, 2009

(86) PCT No.: PCT/EP2009/064539

§ 371 (c)(1),
(2), (4) Date: Apr. 29, 2011

(87) PCT Pub. No.: WO2010/060754

PCT Pub. Date: Jun. 3, 2010

(65) Prior Publication Data

US 2011/0214470 A1 Sep. 8, 2011

(30) Foreign Application Priority Data

Nov. 3, 2008 (IT) ..... MI2008A1933

(51) Int. Cl.
*B21C 33/00* (2006.01)
*B21C 27/00* (2006.01)

(52) U.S. Cl.
USPC ..... 72/272; 72/270

(58) Field of Classification Search
USPC ..... 72/270, 272, 253.1, 273.5, 263, 265, 72/266, 273
See application file for complete search history.

(56) References Cited

U.S. PATENT DOCUMENTS

| | | | | |
|---|---|---|---|---|
| 2,675,125 | A * | 4/1954 | Genders | 72/271 |
| 3,369,384 | A | 2/1968 | Beneke et al. | |
| 3,369,385 | A * | 2/1968 | Murphy et al. | 72/272 |
| 3,530,702 | A | 9/1970 | De Ridder | |
| 4,365,497 | A * | 12/1982 | Asari | 72/265 |
| 4,379,398 | A * | 4/1983 | Asari et al. | 72/273.5 |
| 4,399,676 | A * | 8/1983 | Noyori et al. | 72/253.1 |
| 4,424,696 | A | 1/1984 | Asari et al. | |
| 4,895,506 | A * | 1/1990 | Nonini et al. | 72/273.5 |
| 5,613,393 | A * | 3/1997 | Bessey | 72/272 |

FOREIGN PATENT DOCUMENTS

| | | |
|---|---|---|
| DE | 19629854 | 7/1997 |
| JP | 4274821 | 9/1992 |

* cited by examiner

*Primary Examiner* — Dana Ross
*Assistant Examiner* — Mohammad I Yusuf
(74) *Attorney, Agent, or Firm* — Stetina Brunda Garred & Brucker

(57) ABSTRACT

An extrusion press comprising a control apparatus for handling the container is described, comprising one or more pairs of control cylinders (40, . . . 43) for handling the container, provided with piston sliding chambers fixed to the container (35), one cylinder of said pair having the rod facing the die platen (25) of the press, the other cylinder of said pair having the rod facing the main cross-piece (20) of the press.

7 Claims, 5 Drawing Sheets

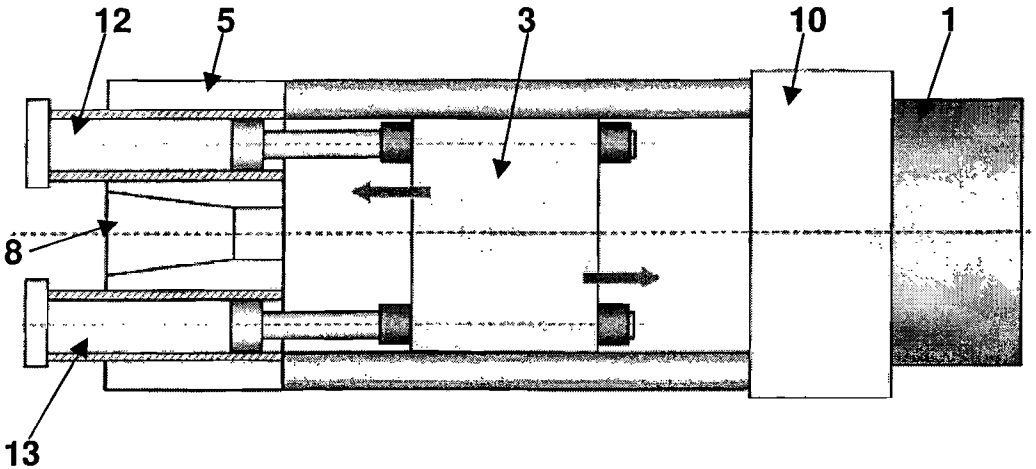
FIG. 2.1
(Prior Art)
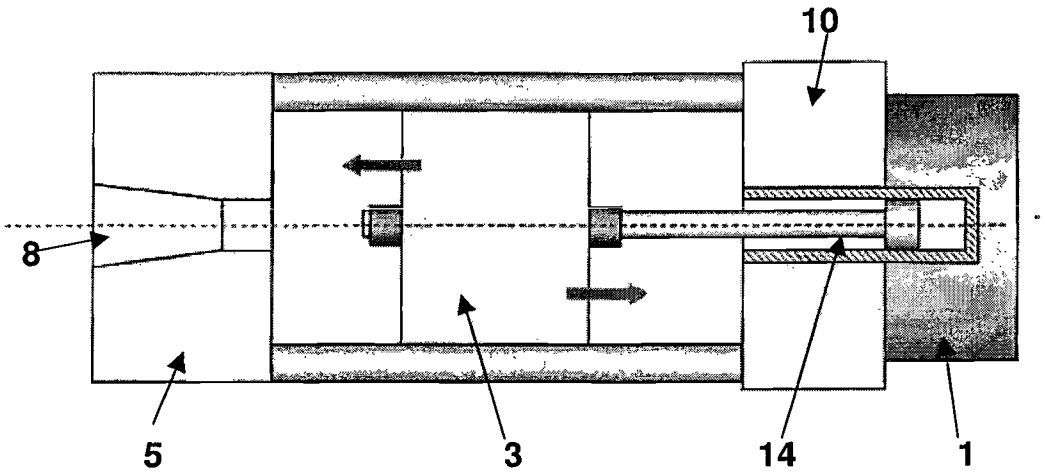
FIG. 2.2
(Prior Art)

FIG. 4.1
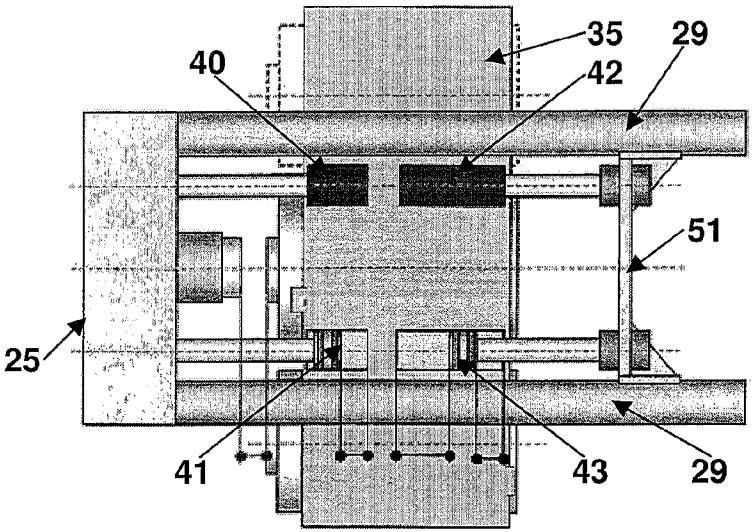
FIG. 4.2
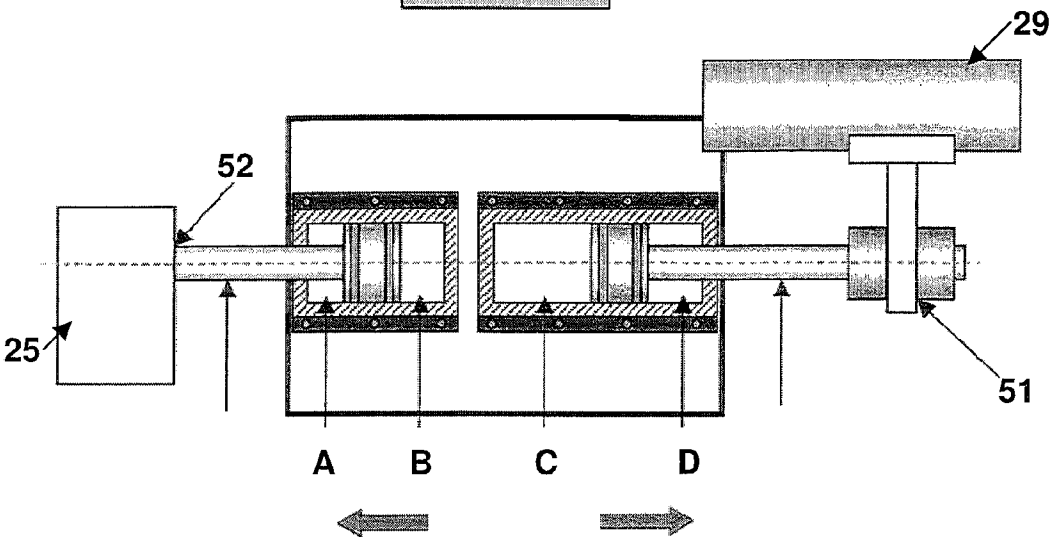

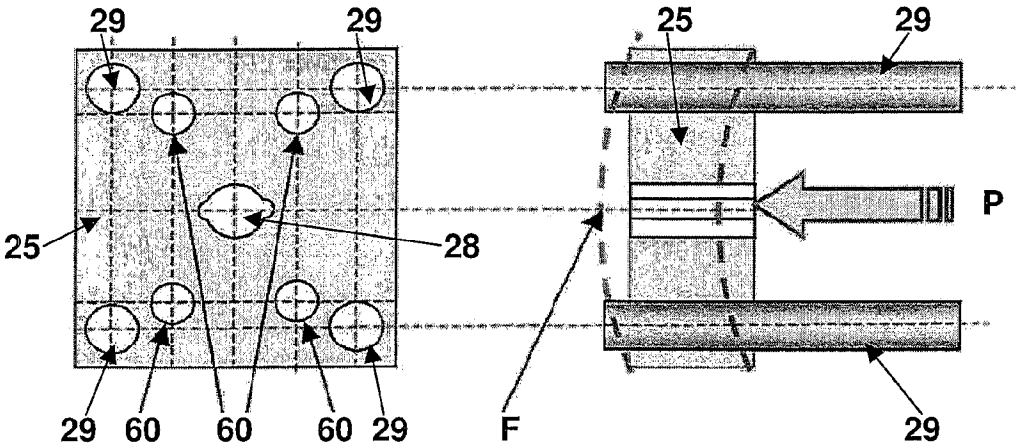
FIG. 5.1
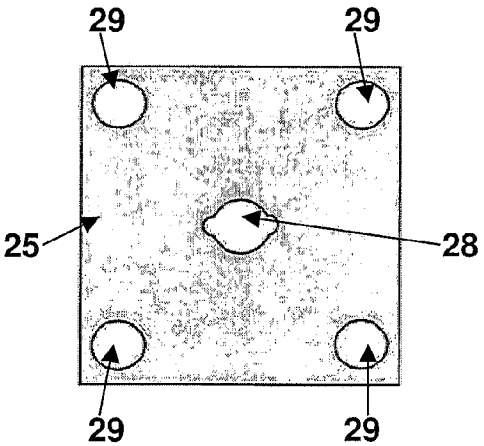
FIG. 5.2

EXTRUSION PRESS COMPRISING A CONTROL APPARATUS AND METHOD FOR HANDLING THE CONTAINER IN SUCH AN EXTRUSION PRESS

FIELD OF THE INVENTION

The present invention relates to a control apparatus and method for handling the container in an extrusion press.

STATE OF THE ART

With reference to FIG. 1, extrusion presses of known type essentially comprise the following components.

There is a main cylinder 1 with the task of providing the thrust or force for deforming a billet 7. The main cylinder 1 is held by means of a main cross-piece 10.

The billet 7 is the starting product for the extrusion process, and may be made of various metals or alloys (aluminium, copper, brass, steel, etc.) and may have various diameters.

A pressing shank 2, forming an extension of the main cylinder 1, has about the same diameter as the billet and serves the function of compressing the billet 7 within a hole 3' provided in a container 3 against a matrix 4.

Container 3 serves the function of containing the billet 7 within the hole 3' during the extrusion process, and directing the flow of metal into the matrix 4.

Matrix 4 is a mold with a machined hole having the shape of the product to be obtained. The metal (deformed by the thrust force of the main cylinder) flows therethrough thus taking the desired shape. Matrix 4 adheres against a die platen element 5, or simply die platen.

The die platen 5 serves to contrast the force of the main cylinder 1. In the middle thereof there is provided a hole 8 allowing the section generated in the matrix 4 to come out. The die platen 5 is firmly connected to the main cross-piece 10 by means of longitudinal columns 9.

Once the billet 7 has been extruded, the container 3 retracts from the matrix 4. During this step, transversally moving shears 6 cut the last piece of billet (named "base") which remains attached to the matrix itself in the space between the matrix and the container.

The forward-backward longitudinal movement of the container is controlled by control cylinders of hydraulic type, the housings of which are normally made in a known manner on the die platen 5 (cylinders 12, 13 in FIG. 2.1) or on the main cross-piece 10 (cylinders 14 in FIG. 2.2).

Said hydraulic control cylinders have some problems concerning the design and the handling control.

Making the housing holes of the cylinders (rods or chambers) in the die platen elements implies evident problems of mechanical machining complexity.

Furthermore, said holes weaken the cross-pieces thus decreasing resistance to fatigue when machining, where considerable forces are involved, thus causing structural flexions of a certain importance.

Cylinder handling control is not optimal and the corresponding forces exerted in forward and backward movements are not well balanced.

Furthermore, the connection of the hydrodynamic feeding pipes of cylinders is particularly difficult, because either the main cross-piece or the die platen element needs to be drilled.

SUMMARY OF THE INVENTION

It is thus the object of the present invention to disclose an apparatus and method for controlling the container handling in an extrusion press, adapted to overcome all the aforesaid drawbacks.

It is the object of the present invention a control apparatus for controlling the container handling in an extrusion press, said extrusion press comprising: a die platen element from which an extruded product exits; a main cylinder held by a main cross-piece for pressing billets made of manufacturing material; longitudinal columns for connecting said main cross-piece and said die platen element; a container adapted to move in the longitudinal direction for housing said billets and pressing against said die platen for the extrusion of said billets, thereby obtaining said extruded product; said apparatus comprising one or more control cylinders pairs for handling said container, said control cylinders being provided with piston sliding chambers fixed to said container, one cylinder in said pair having the rod thereof facing said die platen, the other cylinder in said pair having the rod thereof facing said main cross-piece.

A particular object of the present invention is an apparatus and method for controlling the container handling in an extrusion press, as better described in claims which form an integral part of the present description.

BRIEF DESCRIPTION OF THE DRAWINGS

Further objects and advantages of the present invention will be apparent from the following detailed description of an embodiment thereof (and variants thereof) and from the accompanying drawings given by the way of mere non-limitative example, in which:

FIGS. 2.1, 2.2 show assembly details of the cylinders of the longitudinal handling system for two known types of press;

FIGS. 3, 4.1, 4.2 show the cylinders of the longitudinal handling system according to the invention and their details;

FIGS. 5.1, 5.2 show details of the die platen of a press of known type and according to the invention, respectively.

The same reference numbers and letters in the figures refer to the same elements or components.

DETAILED DESCRIPTION OF PREFERRED EMBODIMENTS

Figure 1:
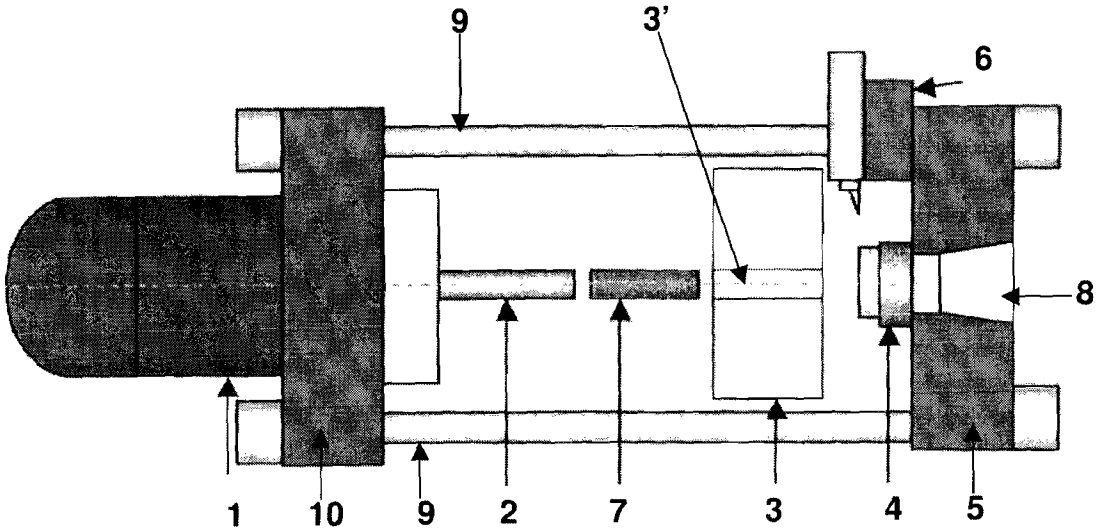
FIG. 1 (Prior Art)
FIG. 1 diagrammatically shows an extrusion press of known type.
Figure 3:
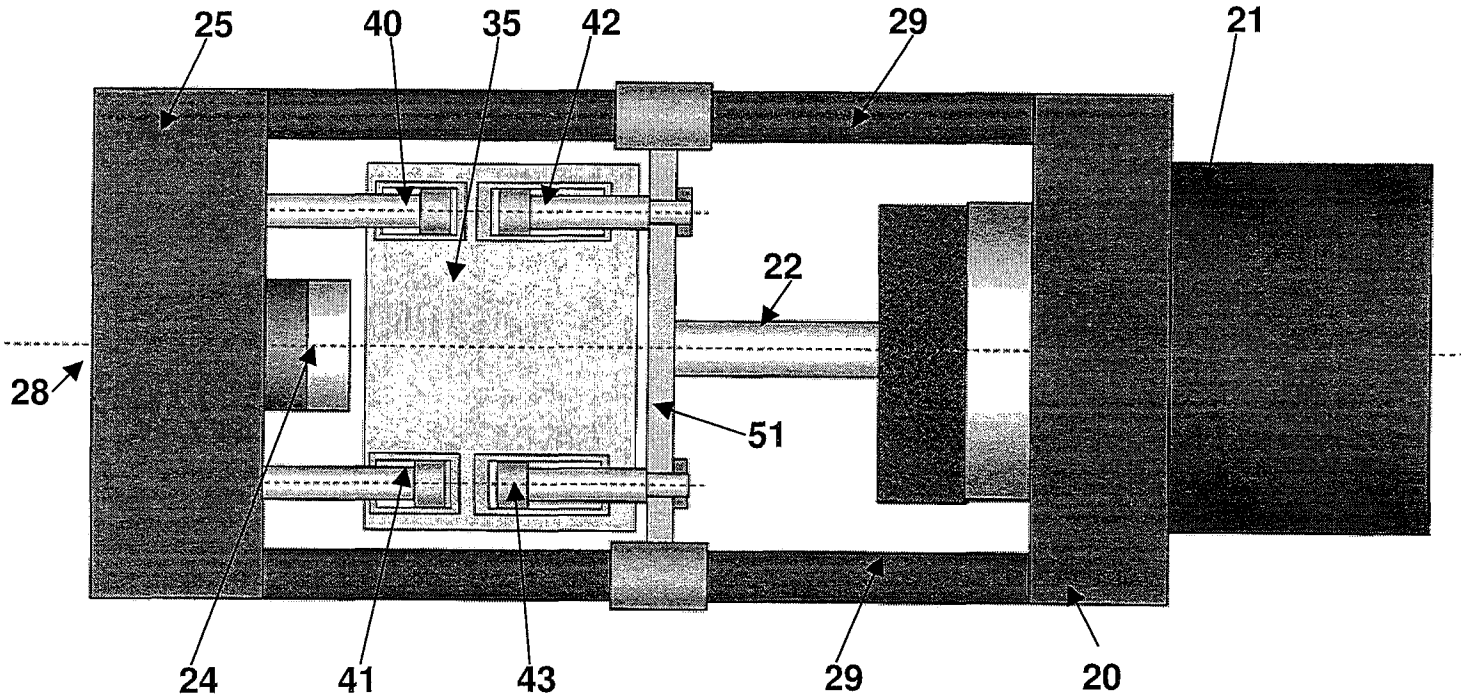

The control system of the container of the extrusion press object of the invention will now be described with particular reference to FIGS. 3, 4.1, 4.2. Numeral 21 indicates a main cylinder of per se known type, fixed to a main cross-piece 20 of an extrusion press. Numeral 22 indicates a pressing shank of per se known type.

Numeral 25 indicates a die platen element in which there is provided a per se known hole 28, in which the matrix 24 is present on the inner side thereof.

Numeral 35 indicates a container adapted to move in a longitudinal direction for extruding the billets.

Numeral 29 indicates longitudinal columns for firmly connecting the main cross-piece 20 and the die platen element 25, or simply die platen.

In accordance with the present invention, pairs of hydrodynamic control cylinders 40, 41, 42, 43 are fixed to the external walls of the container 35 for controlling the longitudinal movement of the container.

In the non-limitative example described herein, there are two pairs of cylinders facing to each other and being opposite on the two opposite sides of the container 35. In particular, FIG. 3 shows four cylinders 40, 41, 42, 43 present on an external side wall of the container.

An equal number of cylinders (not shown) is present on the opposite external side wall. One or more pairs of opposite cylinders may be present, as needed.

Cylinders 40, 41 facing the die platen 25 have the rod 52 abutting the die platen itself, while cylinders 42, 43 facing the main cross-piece 10 have the rod fixed to the columns 29 by means of one or more fastening elements 51.

The chambers in which the cylinder pistons slide are double and closed, and are fixed to the opposite external faces of the container 35. The cylinders 40, 41 with the rod facing the die platen 25 have two chambers indicated by letters A and B, while the cylinders 42, 43 facing the main cross-piece 20 have two chambers indicated by letters C and D. Chambers B and C are front chambers facing the head of the piston, while chambers A and D are rear chambers facing the cylinder rod. Said chambers are appropriately pressurized to determine the forward and backward movement of the container 35. More in particular, the longitudinal movement cycle of the container is controlled by the cylinders as follows.

After extruding a billet, chambers B+D work to obtain an opening movement with pull retraction, at the end of which (normally 30/40 mm) the retraction stroke proceeds with chamber B.

During the steps of shearing and then loading the new billet, chambers B and C are kept pressurized (e.g. at 30/40 bars). Thereby, the container will not move and will firmly remain steady.

Chamber D is pressurized after total opening.

Upon closure and following locking of the container against the matrix, chamber C is pressurized.

Chamber C is pressurized during the active working cycle.

Unlike the control cylinder system of known type, in which the forces of opening and closing the container are different and imbalanced, the forces of opening and closing the container in the system according to the invention are equivalent and balanced.

The main function of the die platen 25 is to contrast the force impressed by the main cylinder 21, thus making the press an hyperstatic system.

Despite the hyperstaticity of the system, the die platen undergoes a flexion F (dashed lines in FIG. 5.1) caused by the pressure P on the billet, and thus on the matrix, which may even be of the order of thousands of tons. Typical flexion values F may be 0.6/1.2 mm in the middle of the die platen. The flexion of the die platen negatively affects the extrusion position accuracy because the matrix 24 also bends, thus negatively affecting the extruded section thickness.

Therefore, in presses of known type, the presence of the holes 60 (FIG. 5.1) in which the control cylinders are accommodated weakens the die platen, making it more subject to flexion, while said holes are no longer present in the die platen according to the invention (FIG. 5.2), thus making it more robust and less subject to flexion because the control cylinder rods are engaged on the die platen without drilling is required.

Other possible design variants of the described non-limitative example are possible, without therefore departing from the scope of protection of the present invention, thus comprising all the equivalent implementations for a person skilled in the art.

The advantages deriving from the application of the present invention are apparent.

In presses of known type, the presence of holes in the die platen in which the control cylinders are accommodated weakens the die platen itself, thus making it more subject to flexion, while said holes are no longer present in the die platen-piece according to the invention, making it more robust and less subject to flexion. Furthermore, not less importantly, expensive mechanical machining operations for making the holes accommodating the cylinders within structural elements of the press are eliminated.

The system according to the invention has equivalent, balanced forces of opening and closing the container.

The pistons may be smaller with a smaller bore, because a sum of forces in the cylinder pairs is achieved, and thus less expensive.

An absolute position accuracy of opening and closing the container is thus obtained.

The active working cycle may be exploited, regardless of the type of matrix and under all situations which may occur during extrusion, without further incorporated, expensive systems, simply by using the front cylinder in a not completely closed position, when closing.

From the description above, a person skilled in the art will be able to implement the object of the invention without introducing further constructional details.

The invention claimed is:

1. An extrusion press comprising a control apparatus for handling a container in an extrusion press, said extrusion press further comprising:

a die platen element from which an extruded product exits;

a main cylinder held by a main cross-piece for pressing billets made of manufacturing material;

longitudinal columns for connecting said main cross-piece and said die platen element;

a container adapted to move in the longitudinal direction for housing said billets, and pressing against said die platen element for the extrusion of said billets, thereby obtaining said extruded product;

said control apparatus comprising one or more control cylinders pairs for handling said container, said control cylinders being provided with chambers, in which a respective piston can slide, said chambers being arranged outside the die platen element and outside the main cross-piece and fixed to said container, the one cylinder in said pair having a rod thereof facing said die platen element, the other cylinder in said pair having a rod thereof facing said main cross-piece.

2. The extrusion press as in claim 1, wherein said chambers of said one or more control cylinder pairs are facing and opposite relative to each other, and are secured to outer faces of the container.

3. The extrusion press as in claim 2, wherein more than one control cylinder pair is secured to opposite outer faces of the container.

4. The extrusion press as in claim 1, wherein said rod facing the die platen element is in abutting engagement with said die platen element, while said rod facing said main cross-piece is secured to one of said longitudinal columns.

5. The extrusion press as in claim 1, wherein said sliding chambers of said one or more control cylinder pairs are double and closed, having a front chamber facing the piston head, and a rear chamber facing the piston rod.

6. A method for handling a container in an extrusion press, the extrusion press including a die platen element from which an extruded product exits, a main cylinder held by a main cross-piece for pressing billets made of manufacturing material, longitudinal columns for connecting said main cross-piece and said die platen element, a container adapted to move in the longitudinal direction for housing said billets, and pressing against said die platen element for the extrusion of said billets, thereby obtaining said extruded product, wherein said extrusion press includes a control apparatus for handling said container, the control apparatus comprising one or more control cylinders pairs for handling said container, said control cylinders being provided with chambers, in which a respective piston can slide, each of said chambers being double and closed, having a front chamber facing the piston rod; said chambers being arranged outside the die platen element and outside the main cross-piece and fixed to said container, the one cylinder in said pair having a rod thereof facing said die platen element, the other cylinder in said pair having a rod thereof facing said main cross-piece, the method comprising the steps of:

at an end of a billet extrusion, pressurizing a front chamber of the cylinder with the rod facing the die platen element and a rear chamber of the cylinder with the rod facing the main cross-piece, in order to obtain an opening movement of the container with a pull backward movement, at an end of which continuing a backward travel of the container by pressurizing said front chamber;

during a shearing and successive loading steps of a new billet, pressurizing the front chamber of the cylinder with the rod facing the die platen element and a front chamber of the cylinder with the rod facing the main cross-piece, while holding the container steady;

upon a complete opening of the container, pressurizing the rear chamber of the cylinder with the rod facing the main cross-piece;

upon a closure and following locking of the container against the die platen element, pressurizing the front chamber of the cylinder with the rod facing the main cross-piece;

during an active processing cycle, pressurizing the front chamber of the cylinder with the rod facing the main cross-piece, while holding the container steady.

7. An extrusion press comprising a control apparatus for handling a container of the extrusion press, said extrusion press further comprising:

a die platen element from which an extruded product exits;

a main cylinder held by a main cross-piece for pressing billets made of manufacturing material;

longitudinal columns for connecting said main cross-piece and said die platen element;

a container adapted to move in the longitudinal direction for housing said billets, and pressing against said die platen element for the extrusion of said billets, thereby obtaining said extruded product;

said control apparatus comprising one or more control cylinders pairs for handling said container, said control cylinders being provided with chambers, in which a respective piston can slide, said chambers being arranged outside the die platen element and outside the main cross-piece and fixed to said container, the one cylinder in said pair having a rod thereof facing said die platen element, the other cylinder in said pair having a rod thereof facing said main cross-piece, and wherein said rod facing the die platen element is in abutting engagement with said die platen element, while said rod facing the main cross-piece is secured to one of said longitudinal columns.

* * * * *